United States Patent [19]

McLaughlin

[11] 4,246,769

[45] Jan. 27, 1981

[54] CAM FOR CABINET LOCKING SYSTEM

[75] Inventor: Gordon McLaughlin, Beachburg, Canada

[73] Assignee: Storwal International Inc., Pembroke, Canada

[21] Appl. No.: 947,296

[22] Filed: Sep. 25, 1978

[30] Foreign Application Priority Data

Sep. 20, 1978 [CA] Canada ..... 311719

[51] Int. Cl.[3] ..... E05B 65/46

[52] U.S. Cl. ..... 70/85; 292/34; 292/165; 312/219

[58] Field of Search ..... 70/85; 312/107.5, 216–219; 292/34, 37, 165, 169, 197, 222, 224; 74/567, 569

[56] References Cited

U.S. PATENT DOCUMENTS

| | | | |
|---|---|---|---|
| 912,219 | 2/1909 | Holland | 312/219 |
| 1,807,775 | 6/1931 | Devereaux | 292/224 |
| 1,993,139 | 3/1935 | Grohman | 292/34 X |
| 2,793,927 | 5/1957 | Reitzel | 312/219 |
| 2,966,384 | 12/1960 | Bergman | 312/218 |
| 3,767,280 | 10/1973 | McLaughlin | 312/219 |

FOREIGN PATENT DOCUMENTS

| | | | |
|---|---|---|---|
| 2307943 | 11/1976 | France | 312/219 |

*Primary Examiner*—William E. Lyddane

*Attorney, Agent, or Firm*—Rogers, Bereskin & Parr

[57] ABSTRACT

A gang locking system for use in furniture cabinets having a plurality of doors or drawers comprises a lock tube which rotates to move a lock bar from a disengaged or open position to an engaged or locked position. Rotation of the lock tube is effected by a lock cam attached to a lock cylinder. The lock cam is a generally rod shaped member having two offsets to constitute a "Z" or zig-zag shape and projects through a pair of slots in the lock tube. The slots in the lock tube have a width only slightly greater than the diameter of the rod-like cam so as to reduce any slack or "play" between the lock cam and the lock tube.

4 Claims, 3 Drawing Figures

CAM FOR CABINET LOCKING SYSTEM

Figure 1:
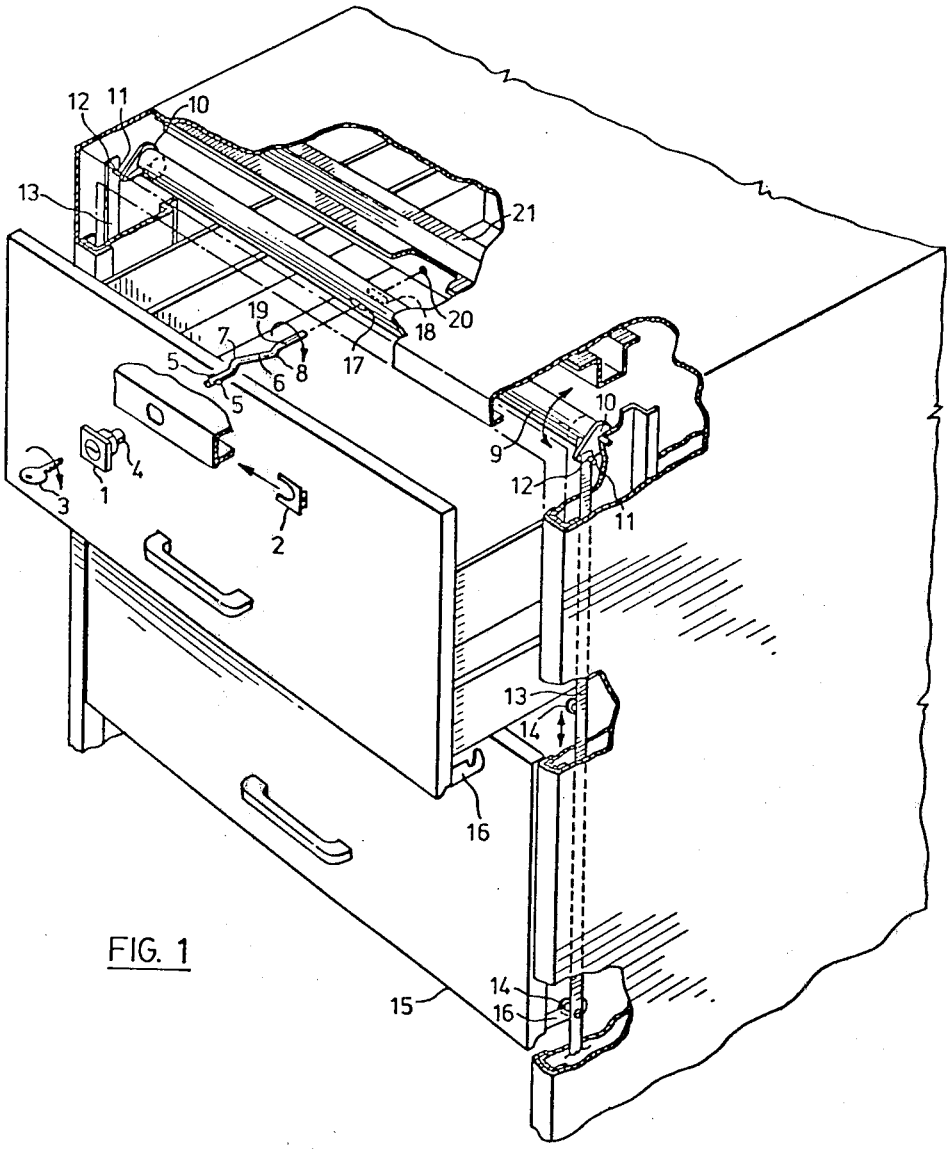

The present invention relates to a locking system for the drawers or doors of articles of furniture and more particularly, to a gang locking system for filing cabinets having multiple drawers or doors.

Various locking systems have been developed for sets of vertically assembled drawers found in articles of furniture such as desks and filing cabinets. Many of the filing cabinets in use today involve a system of doors which swing down to prevent access to the contents of the cabinet. It is advisable, of course, to arrange the locking system so that all the drawers or doors can be locked shut by use of one lock and key. A number of single lock locking systems have been devised, but most of these have been quite complex and expensive to manufacture.

An example of a complex locking system is illustrated in U.S. Pat. No. 2,793,927 to Reitzel. This patent describes a single lock multiple drawer locking mechanism which utilizes a complex striker and lock dog mechanism which interact upon operation of the locking arrangement in the system. Another complex system is disclosed in Bergman U.S. Pat. No. 2,966,384 comprising a vertical locking bar which is actuated by a horizontally moving cam plate.

A locking system for drawers located in furniture such as desks and filing cabinets has been developed which is of simple construction and is quite economical to manufacture. This system is shown in my U.S. Pat. No. 3,767,280, issued Oct. 23, 1973. This system comprises a lock rod member which is rotated by a member located on the cylinder of the lock used. Through a simply arranged crank system the lock rod member raises and lowers a lock bar located in the sides of the article of furniture and this lock bar has locking studs attached thereto which engage with the lock brackets on the sides of the drawers to prevent outward motion of the drawer.

As with all locking systems for use with gang lock arrangements, security is of utmost importance. In order to prevent theft by prying at the cabinet or at any of the engagement points, it is desirable to have a mechanism which limits movement between the various members in the gang lock mechanism. Accordingly, in order to provide better security it is desirable that each of the members of the system be affixed to the cooperating member so as to provide no loss of motion or play between the parts.

It is an object of the present invention to provide a simple and economically constructed drive mechanism for rotating a lock rod member which mechanism minimizes any slackness or looseness between the drive mechanism and the lock rod member.

According to this invention a simple drive member or lock cam to operate a lock rod member comprises a rod-like member having two offsets so as to provide a substantially "Z" shaped drive member. The lock cam projects through two slots in a horizontally arranged lock rod member or tube with the width of the slots being only slightly greater than the radius of the lock cam. The "Z" configuration of the lock cam provides an eccentric such that rotation of the cam within the slot of the lock rod member will cause rotation of the lock rod member.

Figure 2:
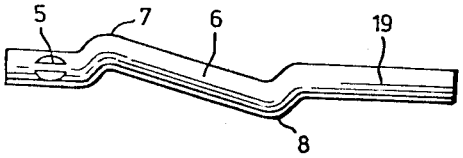
Figure 3:
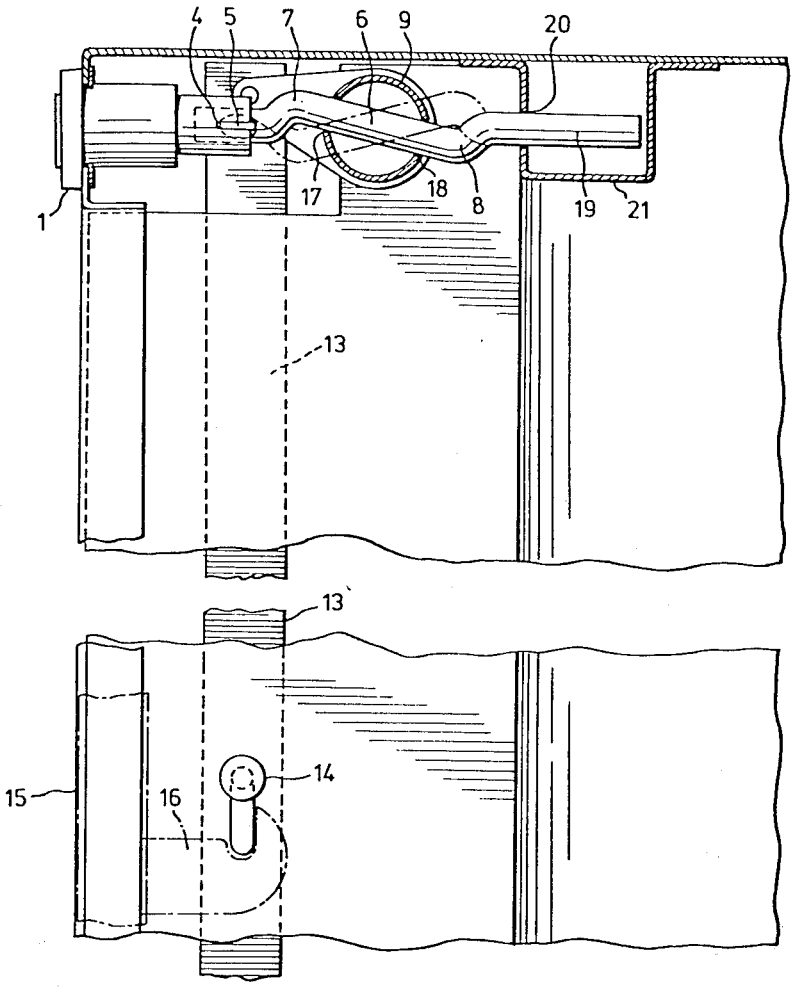

Other objects and advantages of the invention will be apparent from the description following taken in conjunction with the accompanying drawings in which:

FIG. 1 is an exploded perspective view of a preferred embodiment of the invention for use in a two drawer cabinet illustrating the lock rod and lock cam member, FIG. 2 is an elevation view of the lock cam member, and FIG. 3 is a vertical section through the assembled mechanism illustrating the operation of the cam member.

Referring specifically to FIG. 1 of the drawings, a gang lock mechanism for a two drawer filing cabinet is shown in an exploded perspective view. The Figure illustrates the components of a key operated system wherein rotation of a key, rotates a lock cam and thereby causes rotation of a lock rod to move lock bars from a disengaged position to an engaged position.

The locking mechanism comprises a lock 1 located in a convenient portion of the cabinet by means of a securing clip 2. The lock 1 is operated by means of a key 3. The rear portion of the lock cylinder advantageously comprises a pair of slots 4 into which bosses or projections 5 on the lock cam 6 may be fit so as to effect rotation of the lock cam 6 upon rotation of the lock 1. The lock cam 6 is a generally rod shaped member having a double offset 7 and 8 so as to comprise a substantially "Z" or zig-zag shape. A generally horizontal lock tube member 9 is affixed to a cabinet wall by a tube axle 10. Each tube axle comprises an eccentric or offset portion 11 having a tang or projection. Each such tang or projection co-operates with a slot or hole 12 in a substantially vertically arranged lock bar 13. For the purposes of security the lock bars are located in fully enclosed spaces in the wall of the cabinet, preferably on either side of the gang of drawers to be locked. A plurality of stud members 14 project from the lock bar one stud being provided for each drawer to be locked. Each drawer 15, a portion of which is illustrated in FIG. 1, is equipped with a hook 16 or other simple mechanism for engaging the stud 14 projecting from the lock bar 13. As will be appreciated by those skilled in the art the drawers 15 of the cabinet may be maintained in the locked position by moving the verticle lock bar to a downward position after all drawers are closed such that the stud 14 of the lock bar engages the hook 16 fixed to the drawer. When it is desirable to open any of the drawers the lock bar is moved upwardly such that the stud 14 no longer engages the hook 16 on the drawers.

In order to provide the best security for the system the drawers may be locked at both edges. This involves the use of a second drive bar as shown in FIG. 1 which is similar to the lock bar previously described herein.

Raising and lowering the lock bar or bars is accomplished by causing the lock tube axle 10 to rotate such that the eccentric or tang 11 contained on the two axles lifts or lowers the lock bars.

The generally horizontal lock tube 9 contains a pair of diametrically opposed slots 17 and 18. The word obround as used herein is intended to describe a slot having semi-circular ends. In the best mode of utilizing this invention slots 17 and 18 are obround. The obround slots will best minimize any unwanted play between the lock cam 6 and the horizontal lock tube 9. However, an oblong slot will also suffice. Either the obround or oblong slots should however have a width such that the portion of the lock cam between offsets 7 and 8 will pass through the slots with a relatively snug fit. Most advantageously the width of the slots 17 and 18 should not be more than 0.015 inches greater than the diameter of the portion of the lock cam 6 which projects through the slots 17 and 18.

The lock cam 6 as more particularly shown in FIG. 2 comprises a rod like member. At one end of the lock cam 6 there are a pair of bosses or projections 5 which serve to firmly affix the lock cam 6 to the rear of the lock mechanism 1 preventing any relative play between the lock cam 6 and the lock mechanism 1. When assembled the lock cam 6 projects through the slots 17 and 18 in the lock tube 9 so that the central portion of the "Z" or zig-zag projects through the lock tube 9. In order to provide greater security and limit the vertical displacement of the lock cam 6 the end 19 of the lock cam remote from the lock projects into a hole 20 in a reinforcing bar 21. The reinforcing bar 21 is welded to a convenient portion of the furniture cabinet and together with the lock 1 serves to firmly locate the lock cam 6.

With the lock cam 6 in position it will be obvious that the lock cam 6 can be rotated about its general axis by means of the lock 1 but is otherwise fixed in position. The assembled lock 1, lock cam 6, horizontal lock tube 9 and reinforcing brace 21 are shown in FIG. 3. Generally vertical lock bars 13 are in a first position and the lock cam 6 has assumed the position shown in solid lines. When the key 3 is inserted in the lock 1 and the lock is rotated 180° the lock cam 6 will turn about its general axis to assume the position shown in dotted lines in FIG. 3. In the course of rotating the lock cam 6 from the first position to the second position the lock tube 9 will be rotated approximately 30°. The amount of rotation of the lock tube 9 can be arranged as convenient. The greater the extent of the offsets 7 and 8 of the lock cam 6 the more the lock tube 9 will be rotated upon rotation of the lock 1. Preferably the length of slots 17 and 18 is such as to provide sufficient room for the lock cam 2 to rotate 180°. It will be obvious that the greater the offset, the greater the length of slot required. It will be observed that the lock cam 6 projects through the lock tube 9 and engages the lock tube 9 at the edge of both slots 17 and 18. Accordingly, it will be observed that there is almost no lost motion between the cam 6 and the tube 9.

Referring specifically to FIG. 1 of the drawings, a gang lock mechanism for a two drawer filing cabinet is shown in an exploded perspective view. It can be appreciated that the locking mechanism can be used in filing cabinets with only one drawer or with two or more drawers in vertically stacked configuration or it can be used for locking drawers of desks or other types of cabinetry. It will also be appreciated that this gang locking system may be used to maintain cabinet doors as are commonly used for filing cabinets in a closed position so as to prevent access to the interior of the cabinet.

It will also be appreciated that the rotatable lock tube 9 can be located at any convenient portion of the cabinet, either above all doors or drawers or in between any two doors or drawers or if desired, at the bottom of the cabinet.

In the preferred embodiment illustrated herein the lock tube is arranged generally horizontal and the lock bars are vertical. The lock system of this invention can be used in other orientations to fit specific requirements such as locking a series of cupboard doors in which case the lock tube may be generally vertical and the lock bars substantially horizontal.

I claim:

1. In a locking mechanism for doors or drawers of articles of furniture comprising at least one lock bar slidably mounted in a said article and adapted to move from a first position wherein said doors or drawers may be opened to a second position wherein said doors or drawers are locked closed, and a lock rod member adapted to move said lock bar from said first to said second position, and a lock cylinder, the improvement comprising a pair of slots in said lock rod member, a cam member having a general axis perpendicular to said lock rod member, a support to receive and rotatably support one end of said cam member, said lock cylinder adapted to support the other end of said cam member and adapted to cause rotation of said cam member upon rotation of said lock cylinder, said cam member comprising an offset portion, said offset portion projecting through said pair of slots in said lock rod member and, said slots being dimensioned to receive said offset portion to effect rotation of said lock rod member upon rotation of said cam member.

2. The mechanism as defined in claim 1 wherein said cam member is a rod.

3. The mechanism as defined in claim 2 wherein the slots of said lock rod member are diametrically opposed on said lock rod and obround, the longer axis of each of said slots being parallel to the axis of said lock rod member and the shorter axis of each of said slots being not greater than 0.015" greater than the diameter of said cam member.

4. The device of claims 1, 2 or 3 wherein said cam member is a generally "Z" shape.

* * * * *